US009208630B2

(12) United States Patent
Fujita et al.

(10) Patent No.: US 9,208,630 B2
(45) Date of Patent: Dec. 8, 2015

(54) PAPER-SLIP HANDLING DEVICE AND AUTOMATED TRANSACTION DEVICE

(71) Applicant: Hitachi-Omron Terminal Solutions, Corporation, Tokyo (JP)

(72) Inventors: Junji Fujita, Tokyo (JP); Masayasu Ueno, Tokyo (JP); Youta Sasajima, Tokyo (JP); Riichi Kato, Tokyo (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 14/400,693

(22) PCT Filed: Mar. 15, 2013

(86) PCT No.: PCT/JP2013/057342

§ 371 (c)(1),
(2) Date: Nov. 12, 2014

(87) PCT Pub. No.: WO2013/172083

PCT Pub. Date: Nov. 21, 2013

(65) Prior Publication Data

US 2015/0136562 A1 May 21, 2015

(30) Foreign Application Priority Data

May 14, 2012 (JP) ..... 2012-110177

(51) Int. Cl.
*G07D 11/00* (2006.01)
*G07F 7/04* (2006.01)

(52) U.S. Cl.
CPC ..... *G07D 11/0018* (2013.01); *G07D 11/0021* (2013.01); *G07D 11/0024* (2013.01); *G07F 7/04* (2013.01)

(58) Field of Classification Search
CPC ..... B65H 2701/1912; B65H 2301/544; G07D 11/0021; G07D 11/0024; G07D 2211/00; G07F 7/04; G07F 19/202; G07F 19/203
USPC ..... 194/206, 207, 344; 209/534; 235/379
See application file for complete search history.

(56) References Cited

U.S. PATENT DOCUMENTS 4,744,468 A * 5/1988 Goi et al. ..... 209/534
5,836,577 A * 11/1998 Arikawa et al. ..... 270/58.04
2011/0094850 A1* 4/2011 Seki ..... 194/302

FOREIGN PATENT DOCUMENTS

JP 3-192049 8/1991
JP 10-181928 7/1998

(Continued)

OTHER PUBLICATIONS

International Search Report on application PCT/JP2013/057342 mailed Jun. 11, 2013; 1 page.

*Primary Examiner* — Mark Beauchaine
(74) *Attorney, Agent, or Firm* — Foley & Lardner LLP

(57) ABSTRACT

A paper-slip handling device with: a reduced stoppage rate and banknote rejection rate for a deposit/withdrawal device; improved ability to remove foreign material from banknote bundles; improved user-friendliness; and improved reliability, comprising: a deposit/withdrawal unit used for depositing and withdrawal of paper slips, a paper-slip identification unit that identifies paper slips, a temporary holding compartment that temporarily stores deposited paper slips, a plurality of paper-slip storage compartments, and a first paper-slip transport path via which paper slips are transported to the various aforementioned units. The deposit/withdrawal unit has an opening via which paper slips are transferred in a substantially horizontal state, a storage section that stores paper slips in a substantially upright state, and a second paper-slip transport path that connects said opening and storage section. The paper slips are transported via said second paper-slip transport path while being switched between the substantially upright state and substantially horizontal state.

8 Claims, 13 Drawing Sheets

(56) References Cited

FOREIGN PATENT DOCUMENTS

| | | | |
|---|---|---|---|
| JP | 2000-172903 | A | 6/2000 |
| JP | 2001-266211 | A | 9/2001 |
| JP | 2005-259086 | A | 9/2005 |
| JP | 2011-018252 | A | 1/2011 |

* cited by examiner

PAPER-SLIP HANDLING DEVICE AND AUTOMATED TRANSACTION DEVICE

TECHNICAL FIELD

The present invention relates to a paper-slip handling device and an automated transaction device.

BACKGROUND ART

In the past, in an automated transaction device used in a financial institution and the like, paper-slip handling devices have been installed. As an example of the paper-slip handling device, in Patent Literature 1, a configuration is described in which deposited banknotes put in from a deposit/withdrawal opening in the horizontal direction are held and transferred to a storage section, and withdrawal banknotes accumulated in the storage section are held and transferred to the deposit/withdrawal opening in withdrawal.

Also, in Patent Literature 2, a pocket tape deposit/withdrawal device is described in which a user directly puts in deposited banknotes to a storage section disposed substantially vertically, or directly takes out withdrawal banknotes from the storage section through a deposit/withdrawal opening.

Also, in Patent Literature 3, a deposit device is described in which paper slips put in by a user are held temporarily and are thereafter transported to a separation section.

CITATION CIST

Patent Literature

Patent Literature 1: JP-A-2005-259086
Patent Literature 2: JP-A-2000-172903
Patent Literature 3: JP-A-H3-192049

SUMMARY Of INVENTION

Technical Problem

In Patent Literature 1, when banknotes with various sizes whose edge faces are not arrayed are put in is a lump, a skewed state occurs in separating the banknotes, a jam in which the banknotes collide on a sorting gate disposed in a transport path, a delivery defect in the next withdrawal transaction caused by an accumulation defect in the storage section, a reject caused by discrimination incapability for denomination, authenticity and the like, and so on occur. Also, when a foreign material such as a coin is trapped by the banknote bundle, the foreign material is transported to the storage section along with the banknotes which becomes a cause of clogging inside a device.

In the case of Patent Literature 2, because the storage section is disposed substantially vertically, arraying of the edge face of the banknotes (and correction of the skew) by the gravity and removal of the foreign material are possible. However, because the user is required to insert the hand to an innermost part of the deposit/withdrawal opening at the timing of delivering/receiving the banknotes, the user may possibly be scared psychologically of an action of inserting the hand in a country where ATMs are not spread and so on for example. Therefore, so that the ATM is accepted by users of a financial institution, it is required to improve the banknote delivering/receiving performance of the deposit/withdrawal opening.

The case of Patent Literature 3 is a device exclusively used for depositing, and does not match the recycle type (a system of storing the banknotes deposited by a user and using the same in withdrawal by another user). Also, when the device described in Patent Literature 3 is used in a region where a device exclusively used for withdrawal (cash dispenser) is a mainstream, the device exclusively used for withdrawal which discharges the banknotes horizontally and the device exclusively used for depositing in which the banknotes are put in in the vertical state are mixed for the user, which is not preferable from the viewpoint of both of the design characteristics and operably.

Therefore, the purpose of the present invention is to provide a paper-slip handling device and an automated transaction device provided with the paper-slip handling device, the paper-slip handling device having the following goals: a reduced stoppage rate and banknote rejection rate for a deposit/withdrawal device, improved ability to remove a foreign material within the banknote bundles; improved user-friendliness; and improved reliability of the device.

Solution to Problem

In order to solve the problems described above, the present invention is a paper-slip handling device including a deposit/withdrawal unit used for depositing and withdrawal of paper slips, a paper-slip identification unit that identifies the paper slips, a temporary holding compartment that temporarily stores the deposited paper slips, a plurality of paper-slip storage compartments, and a first paper-slip transport path via which the paper slips are transported to the respective units, in which the deposit/withdrawal unit includes an opening via which the paper slips are transferred in a substantially horizontal state, a storage section that stores the paper slips in a substantially upright state, and a second paper-slip transport path that connects the opening and the storage section, with the paper slips being transported via the second paper-slip transport path while being changed between a substantially upright state and a substantially horizontal state.

Advantageous Effects of the Invention

According to the present invention, the stoppage rate of the deposit/withdrawal device caused by banknotes jamming and the like and the rate of rejection caused by the skew can be reduced. Also, the removing performance for the foreign material within the banknote bundle is improved, and the user-friendliness is improved by initiating the operation of the cash dispenser. Further, the reliability of the device can be improved.

DESCRIPTION OF EMBODIMENTS

Below, an embodiment of the present invention will be described using the drawings.

Figure 1:
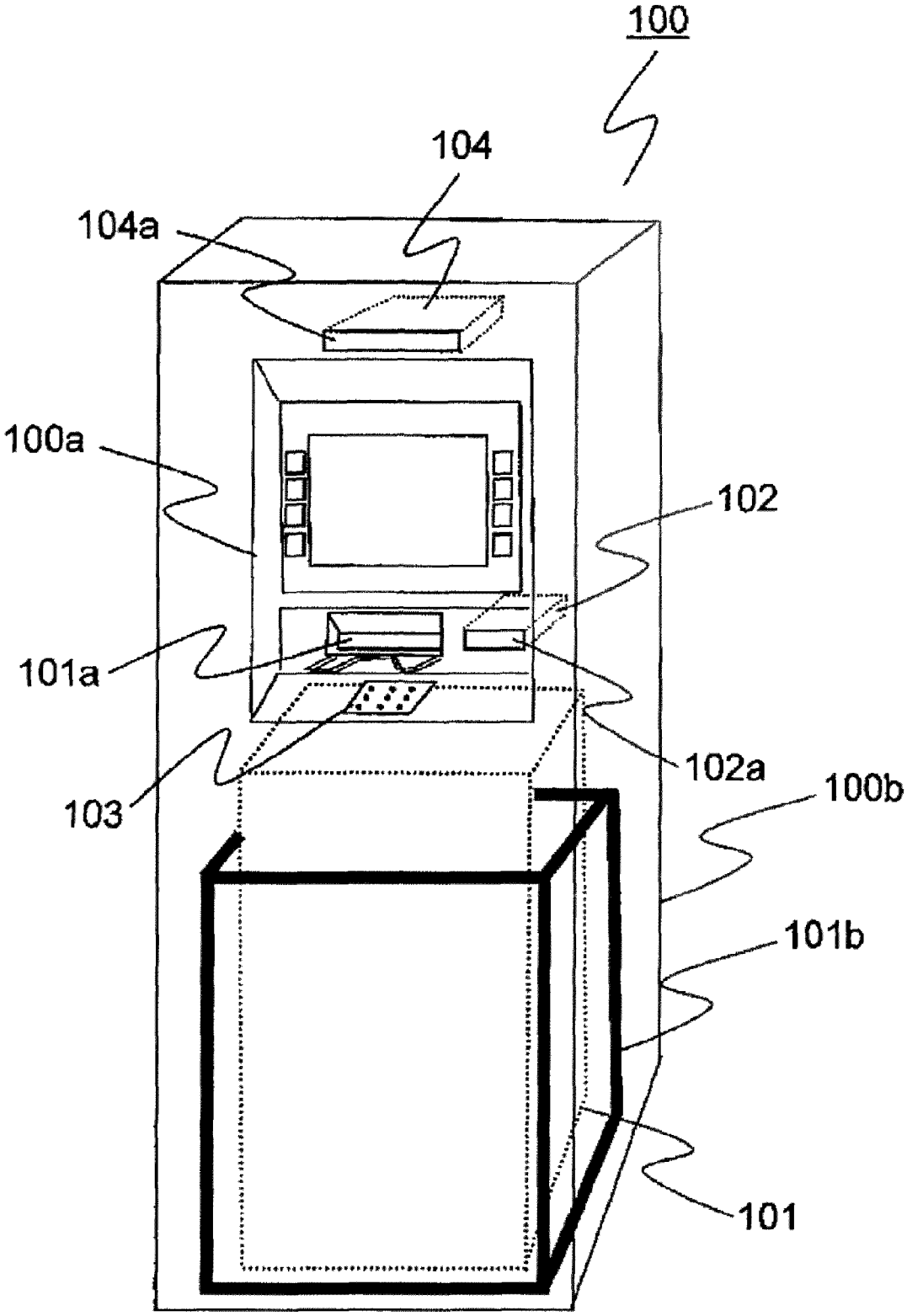
FIG. 1 is a perspective view showing the outer appearance of an automated transaction device.

FIG. 1 is a perspective view showing the enter appearance of an automated transaction device 100. The automated transaction device 100 is a device surrounded by an upper front plate 100*a* and a device casing 100*b*. This automated transaction device 100 can execute processes of depositing, payment, transfer and the like of a user through a media of a card, banknote, detailed slip, and bankbook. Also, in addition to being installed inside a bank, the automated transaction device 100 can cope with an environment operable in a state the user is on an automobile (drive-through environment).

In the inside of the lower part of the device casing 100*b*, a banknote deposit/withdrawal machine (paper-slip handling device ) 101 is provided. The banknote deposit/withdrawal machine 101 is a device for processing the banknotes, and deposit/withdrawal of the banknotes is executed through a banknote slot (an opening through which the banknotes are transferred) 101*a* arranged in the upper front plate 100*a*. Also, a banknote storage section in the lower part of the banknote deposit/withdrawal machine 101 is surrounded by a safe casing 101*b* formed of thick iron plates of several tens mm which is separate from the device casing 100*b*. By making the structure of the safe casing 101*b* more rigid than that of the device casing 100*b*, the security of the banknote deposit/withdrawal machine 101 is further improved.

In the inside of the upper part of the device casing 100*b*, a card/detailed slip processing device 102, a user operation unit 103, and a bankbook handling device 104 are provided. The card/detailed slip processing device 102 processes the card of the user through a card slot 102*a* arranged in the upper front plate 100*a*, prints a transaction detailed slip, and discharges the same. The user operation unit 103 serves as both of a display section that displays the contents of the transaction and an operation section (touch panel and the like) operated by the user. The bankbook handling device 104 executes taking in, printing and discharging of the bankbook of the user through a bankbook slot 104*a* arranged in the upper front plate 100*a*.

Figure 2:
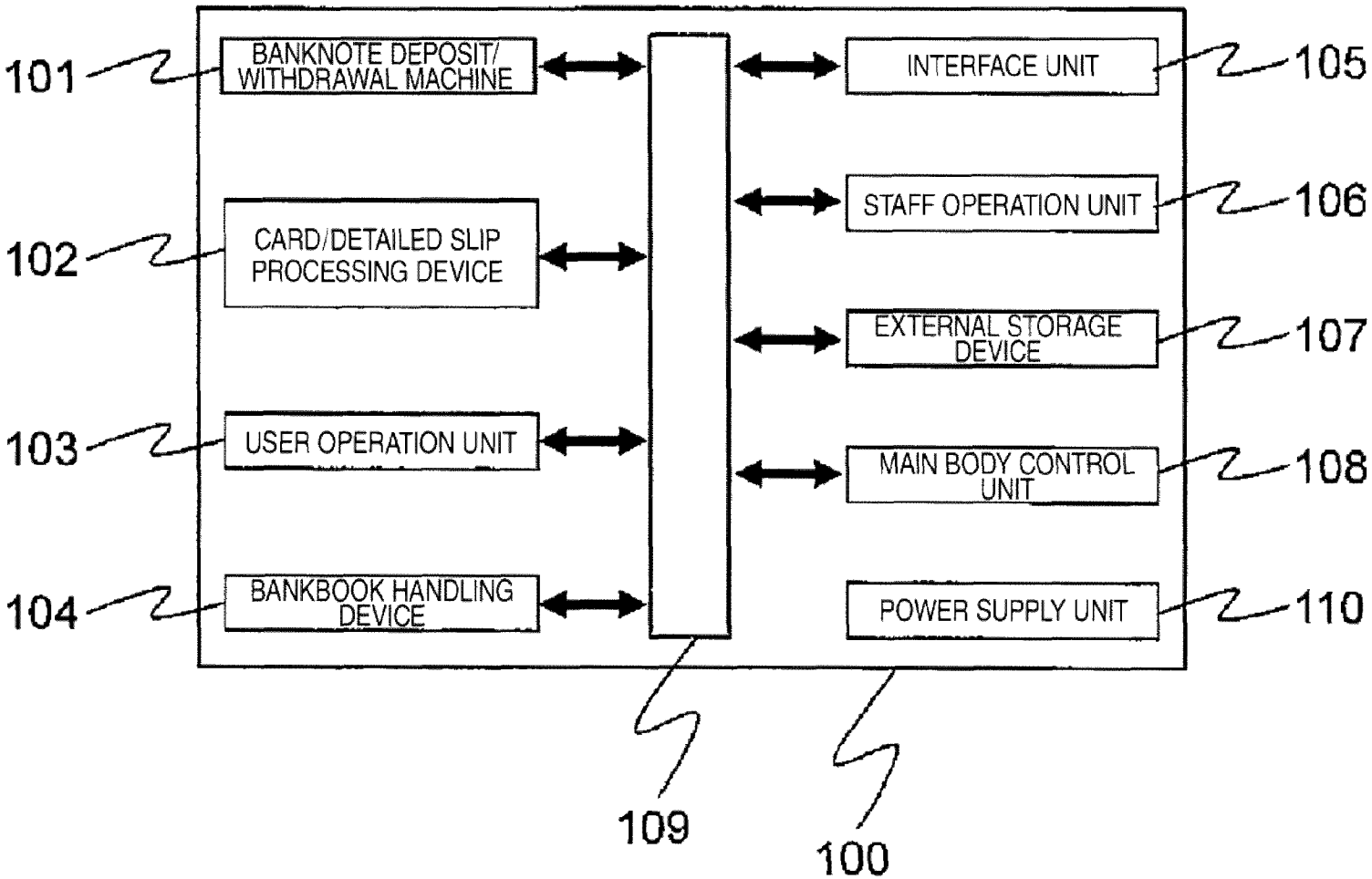
FIG. 2 is a control block diagram showing the control relationship of the automated transaction device.

FIG. 2 is a control block diagram showing the control relationship of the automated transaction device 100.

In addition to the banknote deposit/withdrawal machine 100, the card/detailed slip processing device 102, the user operation unit 103, and the bankbook handling device 104 described above, the automated transaction device 100 includes an interface unit 105, a staff operation unit 106, and external storage device 107, a main body control unit 108, a bus 109, and a power supply unit 110. The staff operation unit 106 serves as both of a display section displaying the maintenance contents of the device and the operation section (touch panel and the like) operated by the user. The external storage device 107 is a storage section for the automated transaction device 101, and is a memory, hard disk, and the like for example. The main body control unit 108 is a CPU and the like controlling each section of the automated transaction device. The bus 109 is a connecting section of the main body control unit 108 and each section of the automated transaction device, and executes communication of required data. The power supply unit 110 supplies electric power to each section of the automated transaction device including the main body control unit 108.

Figure 3:
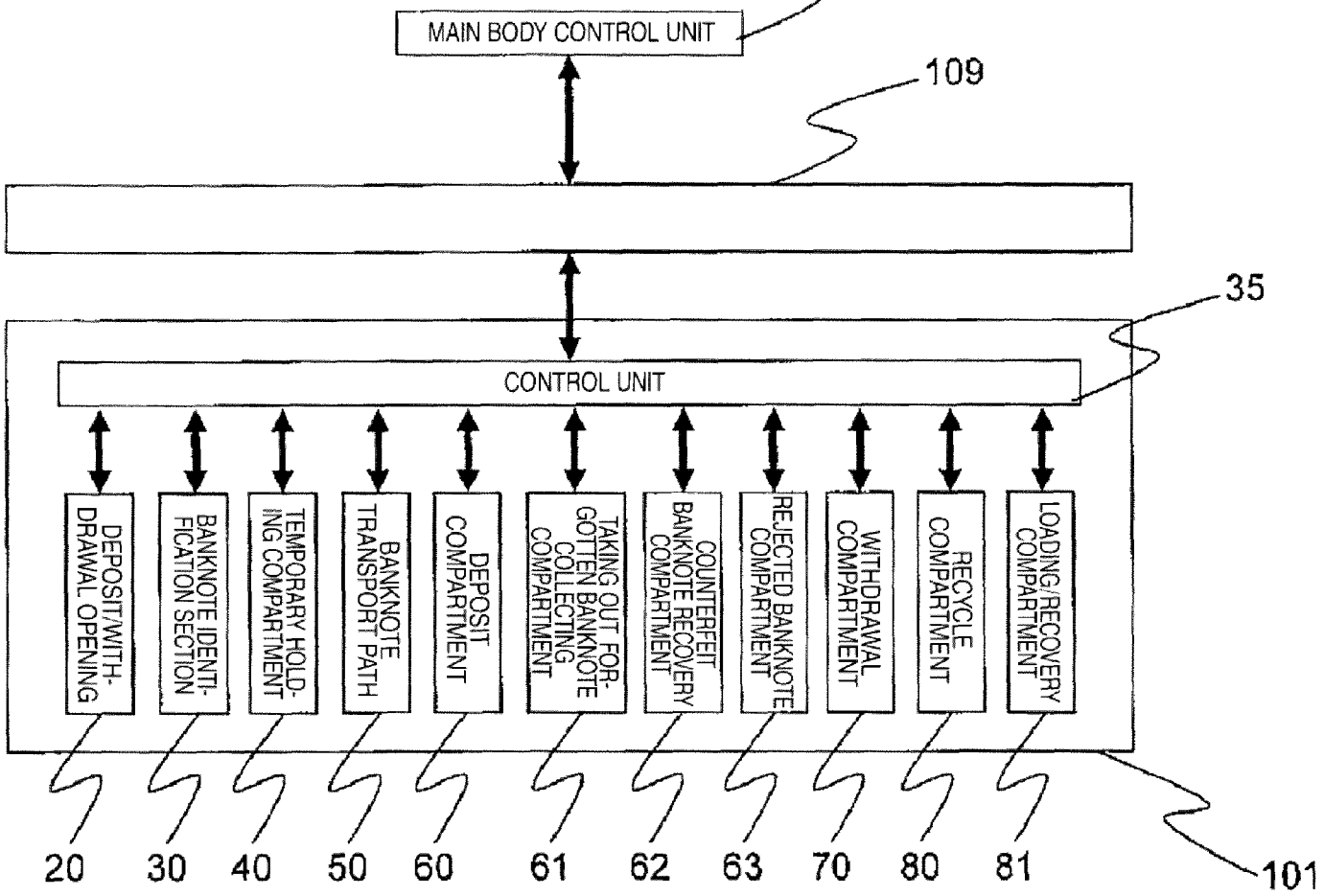
FIG. 3 is a control block diagram showing the control relationship of a banknote deposit/withdrawal machine.

FIG. 3 is a control block diagram showing the control relationship mainly of the banknote deposit/withdrawal machine 101.

A control unit 35 arranged in the banknote deposit/withdrawal machine 101 is connected to the main body control unit 108 of the device through the bus 109, executes control of the banknote deposit/withdrawal machine 101 according to the instruction from the main body control unit 108 and detection of the state of the banknote deposit/withdrawal machine 101, and transmits the state of the banknote deposit/withdrawal machine 100 to the main body control unit 108 according to the necessity. Within the banknote deposit/withdrawal machine 100, the control unit 35 is connected to driving motors, electromagnetic solenoids and sensors of respective units (a deposit/withdrawal opening mechanism 20, a banknote identification section 30, a temporary holding compartment 40, a banknote transport path 50, a deposit compartment 60, a taking out forgotten banknote collecting compartment 61, a counterfeit banknote recovery compartment 62, a rejected banknote compartment 63, withdrawal compartments 70, recycle compartments 80, a loading/recovery compartment 81), and drive-controls an actuator while monitoring the state by sensors according to the transaction.

Figure 4:
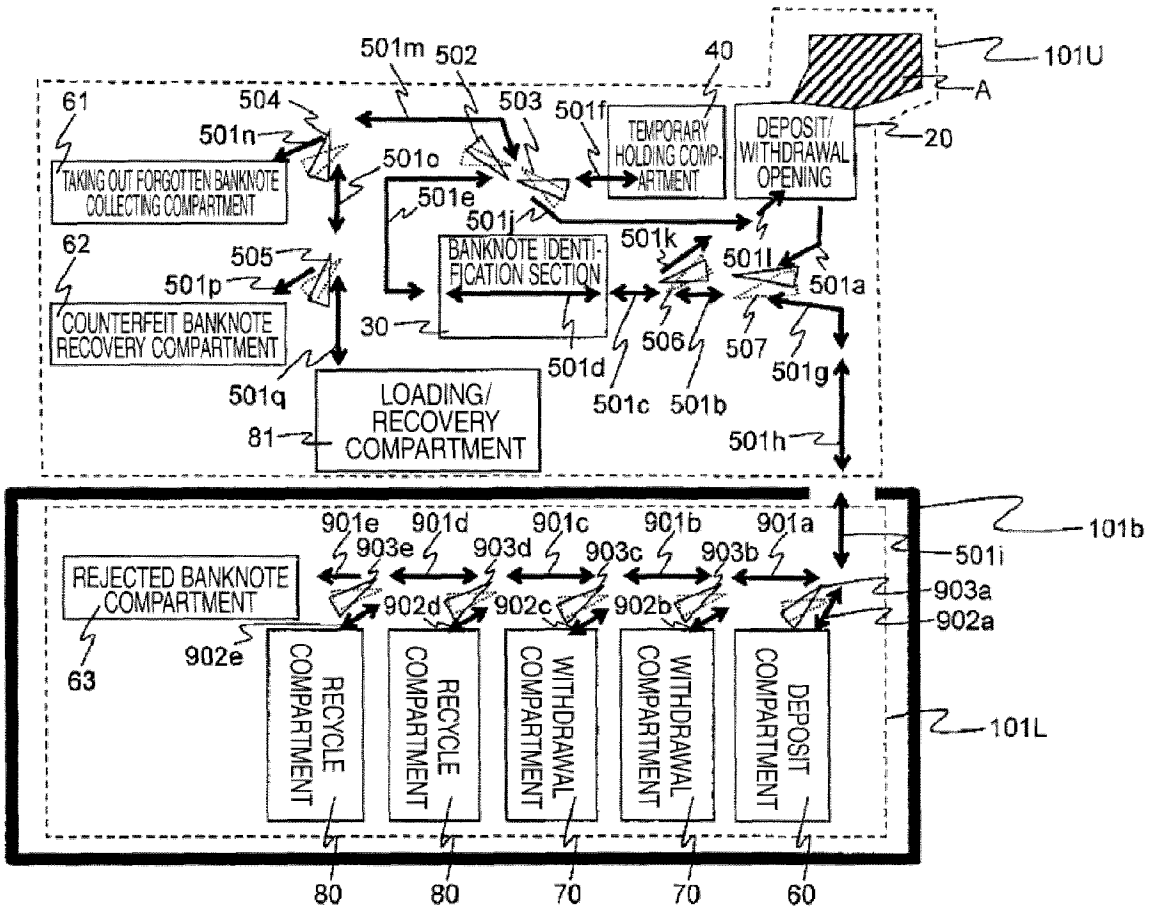
FIG. 4 is an inside configuration drawing of the banknote deposit/withdrawal machine.

FIG. 4 is an inside configuration drawing showing a configuration of the banknote deposit/withdrawal machine 101.

The banknote deposit/withdrawal machine 101 includes the deposit/withdrawal opening mechanism 20 used for depositing and withdrawal of the banknotes, the banknote identification section 30 for identifying the banknotes, the temporary holding compartment 40 for temporarily storing the deposited banknotes until the transaction goes through, the deposit compartment 60 for storing the banknotes whose transaction in depositing has gone through, the taking out forgotten banknote collecting compartment 61 for recovering the banknotes forgotten to take out by the user in depositing and in withdrawal, the counterfeit banknote recovery compartment 62 for storing the banknote identified as a counterfeit banknote, the rejected banknote compartment 63 for storing the banknote unsuitable to withdrawal, a plurality (two in FIG. 4) of the withdrawal compartments 70 for storing the banknotes for withdrawal, a plurality (two in FIG. 4) of the recycle compartment 80 serving to both depositing and withdrawal, and the loading/recovery compartment 81 for storing the banknotes replenished to the recycle compartments 80 and the banknotes recovered from the recycle compartments. Also, banknote transport paths 501*a-q*, 901*a-e* and 902*a-e* for transporting the banknotes to these respective sections, switching gates 502-507 and 903*a-e* for the banknote transport paths, and the control unit (not illustrated) are provided.

In the upper part of the deposit/withdrawal opening mechanism 20, a transport unit A for converting the projecting direction of the banknote from the vertical direction of the device to the front/back direction (the right/left direction of FIG. 4) is provided. The concrete configuration of the transport unit A will be described below.

Because the deposit compartment 60, the withdrawal compartments 70, and the recycle compartments 80 have a common outer shape and the inlets (or outlets, inlets/outlets) for the banknotes thereof are arranged at a same position, the layout can be changed with each other. These deposit compartment 60, withdrawal compartments 70, and recycle compartments 80 having the common construction are referred to as "the banknote storage compartments" for convenience of description. In the plural banknote storage compartments, plural storage sections can be arranged in the inside. Also, instead of disposing the banknote storage compartments in the front/back direction (the right/left direction in FIG. 4) as shown in FIG. 4, the banknote storage compartments may be disposed so as to be stacked in the vertical direction. With these configurations, many denominations can be handled by the banknote deposit/withdrawal machine 101, and application to various operations becomes possible.

The banknote deposit/withdrawal machine 101 is divided into an upper banknote mechanism 101U and a lower banknote mechanism 101L. The upper banknote mechanism 101U includes the deposit/withdrawal opening mechanism, 20, the banknote identification section 30, the temporary holding compartment 40, the taking out forgotten banknote collecting compartment 61, the counterfeit banknote recovery compartment 62, the loading/recovery compartment 81, the banknote transport paths 501*a-h*, 501*j-q*, and the switching gates 502-507. Also, the lower banknote mechanism 101L includes the deposit compartment 60, the rejected banknote compartment 63, the withdrawal compartments 70, the recycle compartments 80, the banknote transport paths 501*i*, 901*a-e* and 902*a-e*, and the switching gates 903*a-e*.

The lower banknote mechanism 101L is installed inside the safe casing 101*b* formed of thick iron plates of approximately 50 mm, and the transport path between the upper banknote mechanism 101U and the lower banknote mechanism 101L is connected by the connection transport paths 501*h* and 501*i*.

The banknote transport paths of the banknote deposit/withdrawal machine 101 will be described. As described above, the banknote transport paths 501*a-q*, 901*a-e* and 902*a-e* connect the deposit/withdrawal opening mechanism 20, the banknote identification section 30, the temporary holding compartment 40, the deposit compartment 60, the taking out forgotten banknote collecting compartment 61, the counterfeit banknote recovery compartment 62, the rejected banknote compartment 63, the withdrawal compartments 70, the recycle compartments 80, and the loading/recovery compartment 81. The arrows showing the banknote transport paths 501*a-q*, 901*a-e* and 902*a-e* are the transport directions of the banknotes. The arrow of one direction represents one-direction banknote transport path through which the banknotes are transported only toward the arrow direction. On the other hand, the arrow of both directions represents two-directional banknote transport path through which the banknotes are transported to both directions.

These banknote transport paths 501*a-q*, 901*a-e* and 902*a-e* are driven by driving motors (not illustrated), and the rotating direction of the motor is switched for every transaction motion. Also, at the branching points of the banknote transport paths 501*a-q*, 901*a-e* and 902*a-e*, the switching gates 502-507 and 903*a-e* are provided. These switching gates switch the banknote transporting direction as shown in the solid line or the dotted line according to the transaction motion.

The connection transport path 501*h* to the lower banknote mechanism 101L is arranged at a position connecting to the banknote transport path 501*g*. Also, the connection transport path 501*i* to the upper banknote mechanism 101U is arranged at a position connecting to the banknote transport path 901*a*. These connection transport path 501*h* and connection transport path 501*i* are arranged at a position connecting to each other. The slit arranged in the upper face iron plate of the safe casing 101*b* has the size of the length allowing the banknote to pass through and the width of a transporting pulley attached so as to hold and deliver the banknotes having been transported to the slit. Also, when such configuration that the lower banknote mechanism 101L is not surrounded by the safe casing 101*b* is adopted, the upper banknote mechanism 101U may just be placed directly on the lower banknote mechanism 101L. With respect to the drive source (motor) for the transport path, although separate drive sources may be arranged for the transport path of the upper banknote mechanism 101U and the transport path of the lower banknote mechanism 101L, it is also possible to use single drive source and to transmit the drive force by gears arranged between the transport paths 501*g*-501*h*-501*i*-901*a*.

The banknote transport paths 902*a-e* contacting any of the deposit compartment 60, the withdrawal compartments 70 and the recycle compartments 80 and arranged in the upper face of the deposit compartment 60, the withdrawal compartments 70 and the recycle compartments 80 are configured to be openable/closable, and taking out the deposit compartment 60, the withdrawal compartments 70 and the recycle compartments 80 to outside the device and removal of the jamming banknote are facilitated. Also, the loading/recovery compartment 81 is optional, and may not be arranged depending on the operation.

With such configuration as described above, the banknote deposit/withdrawal machine 101 executes the deposit/withdrawal motion and the loading/recovering motion for the banknotes, and the recovering motion for the banknotes forgotten to take out. Below, each motion will be described.

First, the banknote deposit/withdrawal motion for the banknotes will be described. The banknote deposit/withdrawal motion for the banknotes is separated into a motion of depositing the banknotes put in by a user to the banknote deposit/withdrawal machine (deposit motion) and a motion of withdrawing the banknotes stored in the banknote deposit/withdrawal machine to the user (withdrawal motion). Also, the deposit motion is separated into a motion of counting the banknotes put in by the user (deposit counting motion) and a motion of storing the banknotes counted to the deposit compartment 60, the rejected banknote compartment 63 and the recycle compartments 80 (deposit storing motion).

Below, the deposit counting motion will be described. The banknote deposit/withdrawal machine 101 separates the banknotes put in to the deposit/withdrawal opening mechanism 20 one by one. Thereafter, the banknote separated is made to pass through the banknote transport paths 501*a-d*, and the denomination and the authenticity are identified by the banknote identification section 30. When the denomination and the authenticity of the banknote could be identified, by switching of the switching gate 503 and so on, the banknotes are made to pass through the banknote transport paths 501*e, f* and are temporarily stored in the temporary holding compartment 40. When the denomination and the authenticity of the banknote could not be identified and when the inclination abnormality and the space abnormality between the banknotes occur, the banknotes are not transported to the temporary holding compartment 40, and the banknote in question is processed as a depositing rejection banknote. At this time, by switching of the switching gate 503 and so on, the banknotes are made to pass through the banknote transport paths 501*e, j*, are transported to the deposit/withdrawal opening mechanism 20, and are retraced to the user. Also, when the banknote has been identified as a counterfeit banknote, by switching of the switching gate 503 and so on, the banknote is made to pass through the banknote transport paths 501*e, m, o, p*, and is stored in the counterfeit banknote recovery compartment 62.

Below, the deposit storing motion will be described in detail. When the transaction is established after the deposit counting motion, by switching of the switching gate 503 and so on, the banknotes stored in the temporary holding compartment 40 are made to pass through the banknote transport paths 501*f, e, d* and are made to pass through the banknote identification section 30. Thereafter, by switching of the switching gate 502 and so on, the banknotes are made to pass through the banknote transport paths 501*c, b, g, h, i*, and are stored in any of the deposit compartment 60, the rejected banknote compartment 63, and the recycle compartments 80. At this time, the banknote transport paths 901*a-e* and 902*a-e* and the switching gates 903*a-e* are controlled, and the banknotes are stored in the storage compartment corresponding to the identification result of the banknote identification section 30. Also, the counterfeit banknote stored in the counterfeit banknote recovery compartment 62 may be stored in the rejected banknote compartment 63 in the deposit storing motion. By completion of these deposit storing motions, the deposit motion finishes.

Below, the withdrawal motion will be described. The banknote deposit/withdrawal machine 101 delivers the banknotes of a predetermined number of sheets from the withdrawal compartments 70 and the recycle compartments 80 and makes the banknotes pass through the banknote transport paths 901*a-e* and 902*a-e*, 501*i, h, g, b, c, d*, and the denomination is identified in the banknote identification section 30. Thereafter, by switching of the switching gate 503 and so on, the banknotes are transported to the deposit/withdrawal opening mechanism 20, and the banknotes are withdrawn for the user. At this time, as described below, the withdrawal banknotes made to pass through the transport unit A is made a state projected beyond the upper front plate 100*a* of the automated transaction device 100, and are thereby allowed to resemble a state of the withdrawal banknotes in the cash dispenser.

Next, the loading/recovering motion for the banknotes will be described. The loading/recovering motion for the banknotes is separated into a motion for storing the banknotes loaded to the loading/recovery compartment 81 in a lump by a staff to the recycle compartments 80 (loading motion), and a motion for recovering the banknotes of a predetermined number of sheets stored in the recycle compartments 80 to the loading/recovery compartment 81 when the recycle compartments 80 has become full and son on (recovering motion). Although transportation of the banknotes in the loading motion and transportation of the banknotes in the recovering motion are via routes of the direction opposite to each other, the detailed description thereof will be omitted. Also, when a rejected banknote comes up in the loading motion/recovering motion, the rejected banknote in question may be stored in the rejected banknote compartment 63, or may be stored in a loading rejection section arranged in the loading/recovery compartment 81.

Next, the recovering motion for the banknotes forgotten to take out will be described. The recovering motion for the banknotes forgotten to take out is a motion for recovering a banknote in question when the depositing rejected banknote in the deposition motion and the withdrawal banknotes have remained in the deposit/withdrawal opening mechanism 20 (when the user forgets to take out). When a predetermined time elapses in a state the depositing rejected banknote and the withdrawal banknotes are stored in the deposit/withdrawal opening mechanism 20, the banknotes stored in the deposit/withdrawal opening mechanism 20 are separated one by one. Thereafter, the separated banknotes are made to pass through the banknote transport paths 501*a-e, m, n*, and are stored in the taking out forgotten banknote collecting compartment 61.

Figure 5:
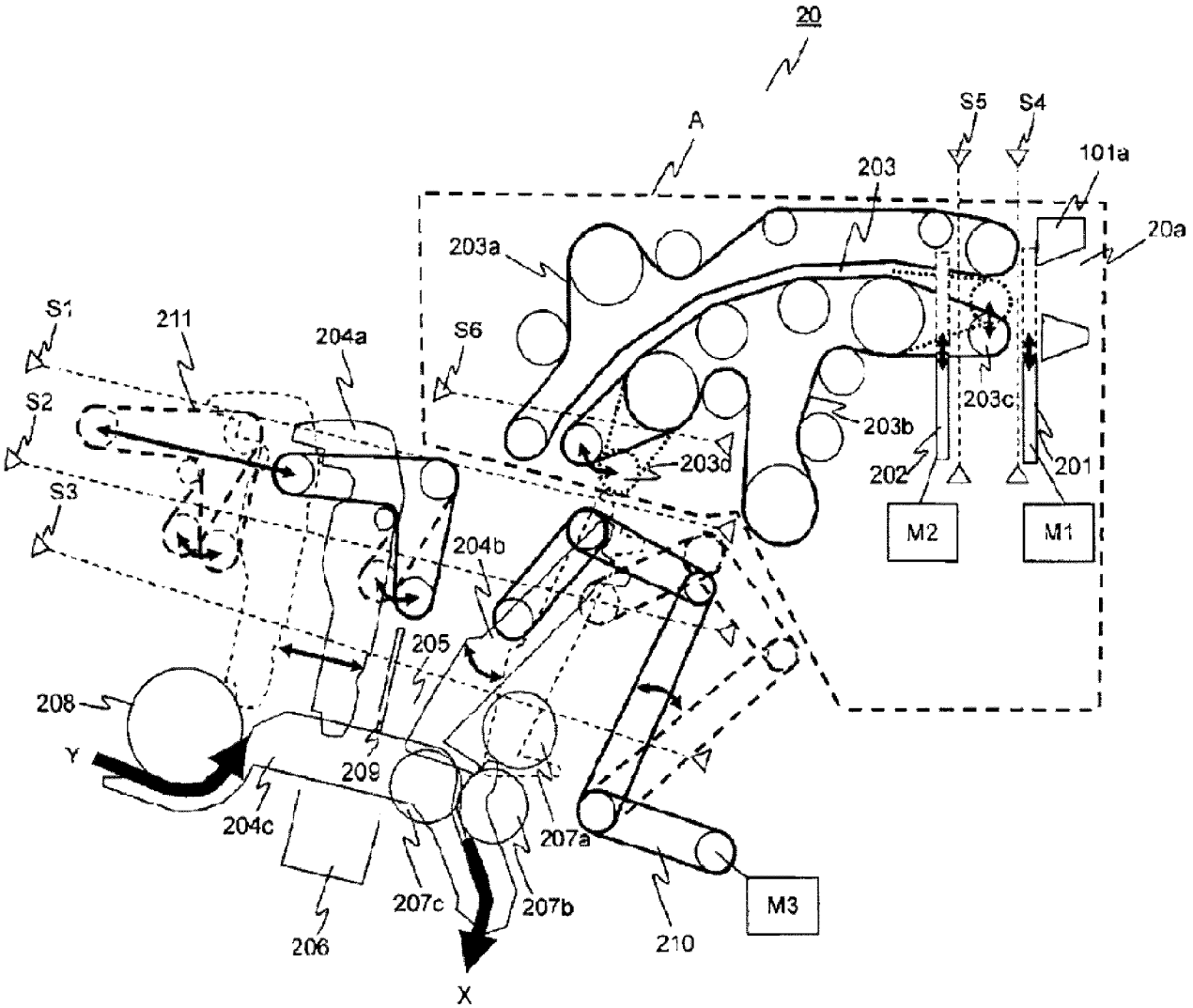
FIG. 5 is an inside configuration drawing of a deposit/withdrawal opening mechanism.

Below, the configuration of the deposit/withdrawal opening mechanism 20 in the present embodiment will be described in detail using FIG. 5. In the upper part of the deposit/withdrawal opening mechanism 20, the transport unit A is arranged. This transport unit A is connected to the lower part of the deposit/withdrawal opening mechanism 20 by a connecting member not illustrated, and is configured to be detachable by unfastening the connecting member.

The deposit/withdrawal opening mechanism 20 is arranged in the inner side of the banknote slot 101*a* of the upper front plate 100*a*. An opening 20*a* is arranged in the mouth of the deposit/withdrawal opening mechanism 20, and it is configured that the banknotes can be deposited and withdrawn in the front/back direction of the device (the right/left direction of FIG. 5) through the opening 20*a*. Behind the opening 20*a*, a shutter 201 is arranged that opens/closes sliding in the vertical direction of the device (refer to the arrow in the vertical direction of FIG. 5) by an actuator M1.

Behind the shutter 201, a stopper that receives and stops the deposited banknotes is arranged. The stopper 202 is configured so as to open/close sliding in the vertical direction of the device (refer to the arrow) by an actuator M2. Thus, the stopper can retreat to a position not colliding on the transported banknotes when the stopper 202 is not used. Also, by configuring the distance between the shutter 201 and the stopper 202 shorter than the length in the short side direction of the banknotes that can be handled by the device, the fear of inserting the hand and fingers can be eliminated when the user puts in the deposit banknotes.

Further, behind the shutter 201, a banknote transport path 203 is arranged which transports the banknotes downward to the back of the device. The banknote transport path 203 transports the banknotes between a storage section 205 described below. The banknote transport path 203 is formed of upper belts 203*a* and lower belts 203*b*, and plural belts are arranged respectively in the device width direction.

On the device front side of the banknote transport path 203, a front roller 203*c* is arranged which is energized in the arrow direction by an elastic member such as a spring and is openable/closable by an actuator not illustrated. Also, on the device back side of the banknote transport path 203, a back roller 203*d* is arranged which is energized in the arrow direction by an elastic member such as a spring and is openable/closable by an actuator not illustrated. Both of the rollers can impart a transporting force by an elastic force of the elastic member to the banknotes in the closed state, and can receive the banknotes in the opened state.

In the lower side to the back of the banknote transport path 203, the storage section 205 formed of a bank plate 204*a*, a front plate 204*b* and a bottom plate 204*c* is arranged. The back plate 204*a* has a position for the time of receiving the banknotes (the solid line in the drawing; hereinafter referred to as "depositing position") and a position for the time of accumulating the withdrawal banknotes from inside the device (the dotted line in the drawing, hereinafter referred to as "taking-in position"), and moves in the direction of an arrow 213 by an actuator not illustrated. Further, in a similar manner, the front plate 204*b* also has a depositing position (the solid line in the drawing) and a taking-in position (the dotted line in the drawing), and moves by links and the like not illustrated. By executing control so that the back plate 204*a* and the front plate 204*b* are moved to an optional position and stop, a proper pressing force can be applied to the banknotes inside the storage section 205. Also, in the bottom plate 204*c*, a slit is arranged. A foreign material having passed through this slit is accumulated in a foreign material receive box 206 arranged below the bottom plate 204*c*.

The banknotes applied with the proper pressing force by the back plate 204*a* and the front plate 204*b* is picked by a pick roller 207*a* one by one, is taken in by a separation roller 207*b* in the direction of an arrow X, and is transported to the banknote transport path 501*a*. A gate roller 207*c* prevents double feeding of the banknotes in delivering by overlapping with the separation roller 207*b*. Also, a stack roller 208 is a roller that transports the depositing rejected banknotes and the withdrawal banknotes transported front the arrow Y direction to the storage section 205.

When the depositing rejected banknote comes up in the deposit counting process, it is necessary to separate the banknotes not yet counted (the banknotes before separation) and the depositing rejected banknote in the inside of the storage section 205. A partition plate 209 is a plate partitioning the storage section 205, and the banknotes not yet counted and the depositing rejected banknote are separated from each other into the front and back of the partition plate 209. The partition plate 209 is operable in the direction same so the moving direction of the back plate 204*a* by an actuator not illustrated.

Below, the configuration of a front clamp 210 and a back clamp 211 which are holding means will be described.

The front clamp 210 is driven synchronizing with the transport pulley through a driving belt with the actuator M1 being a drive source. The driving belt of the front clamp is formed of two belts in the device width direction. Also, the front clamp 210 rotatively driven by an actuator not illustrated between a taking-in position (the solid line in the drawing) and a retreat position (the dotted line in the drawing) of the banknotes.

The back clamp 211 is driven so as to slide in the front/back direction of the device by an actuator not illustrated between a taking-in position (the solid line in the drawing) and a retreat position (the dotted line in the drawing) of the banknotes. Also, a transport pulley on the lower side of the back clamp 211 can move in the arrow direction around the fulcrum of the shaft of a transport pulley on the upper side with an actuator not illustrated being a drive source. The back clamp 21 is energized toward the front of the device by an elastic member such as a spring not illustrated when the back clamp 211 does not contact the banknote. On the other hand, when the back clamp 211 contacts the banknote, the back clamp 211 moves toward the back of the device according to the thickness of the banknotes contacted and imparts a pressing force to the banknotes bundle.

Also, the deposit/withdrawal opening mechanism 20 is provided with optical sensors S1-S6 with each of them being formed of plural pairs, and detects the position of the banknotes by detecting a dark state in which the optical axis of the sensor is blocked.

Below, the motion of the deposit/withdrawal opening mechanism 20 in the present embodiment will be described in detail using FIG. 6-FIG. 13. The deposit/withdrawal opening mechanism 20 executes the motions and processes shown in FIG. 6-FIG. 8 at the time of the deposit counting motion, and executes the motions and processes shown in FIG. 9-FIG. 13 at the time of the withdrawal motion (or the motion of returning the deposited banknotes).

Figure 6:
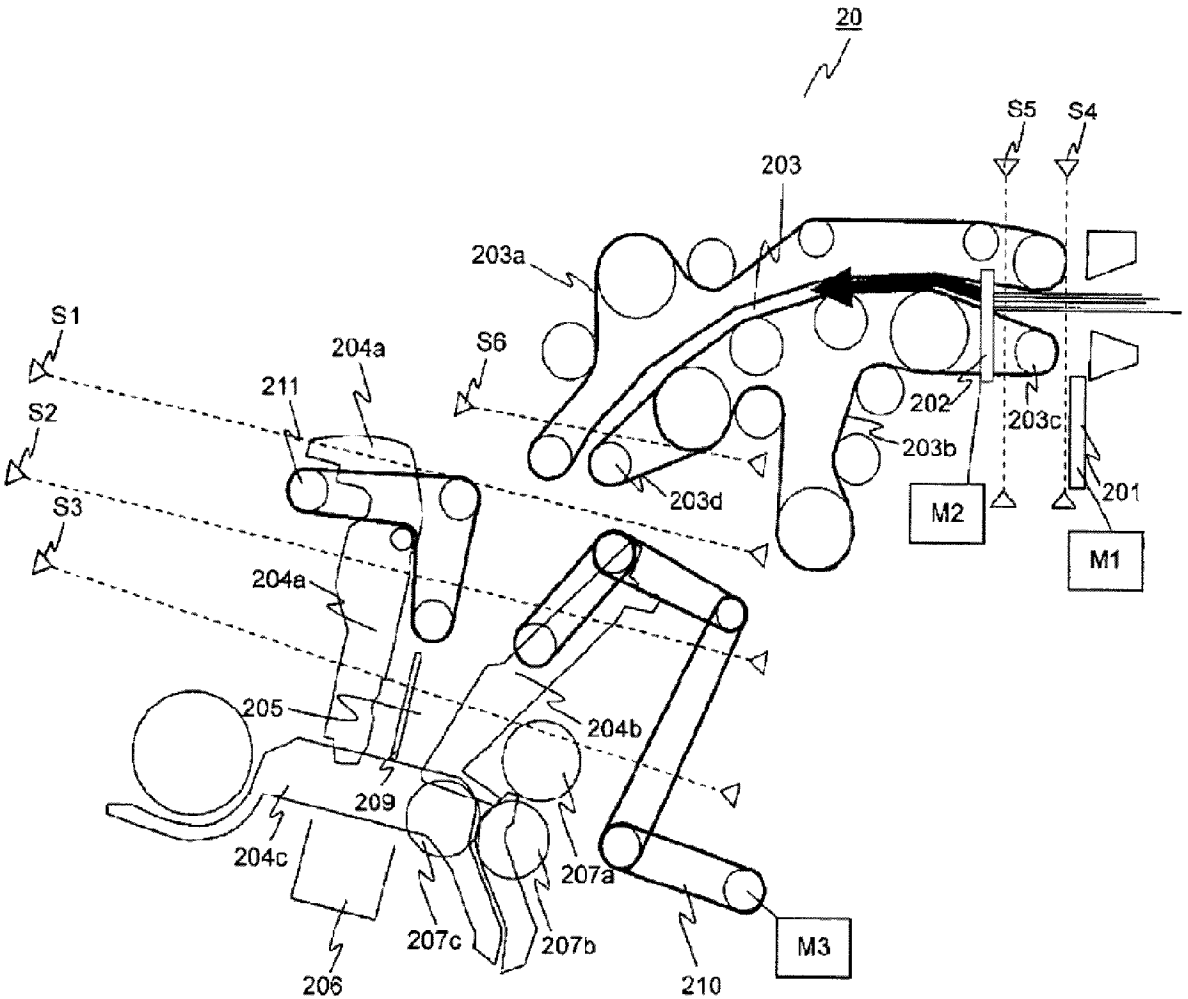
FIG. 6 is an inside configuration drawing of the deposit/withdrawal opening mechanism in the deposit counting motion.
Figure 7:
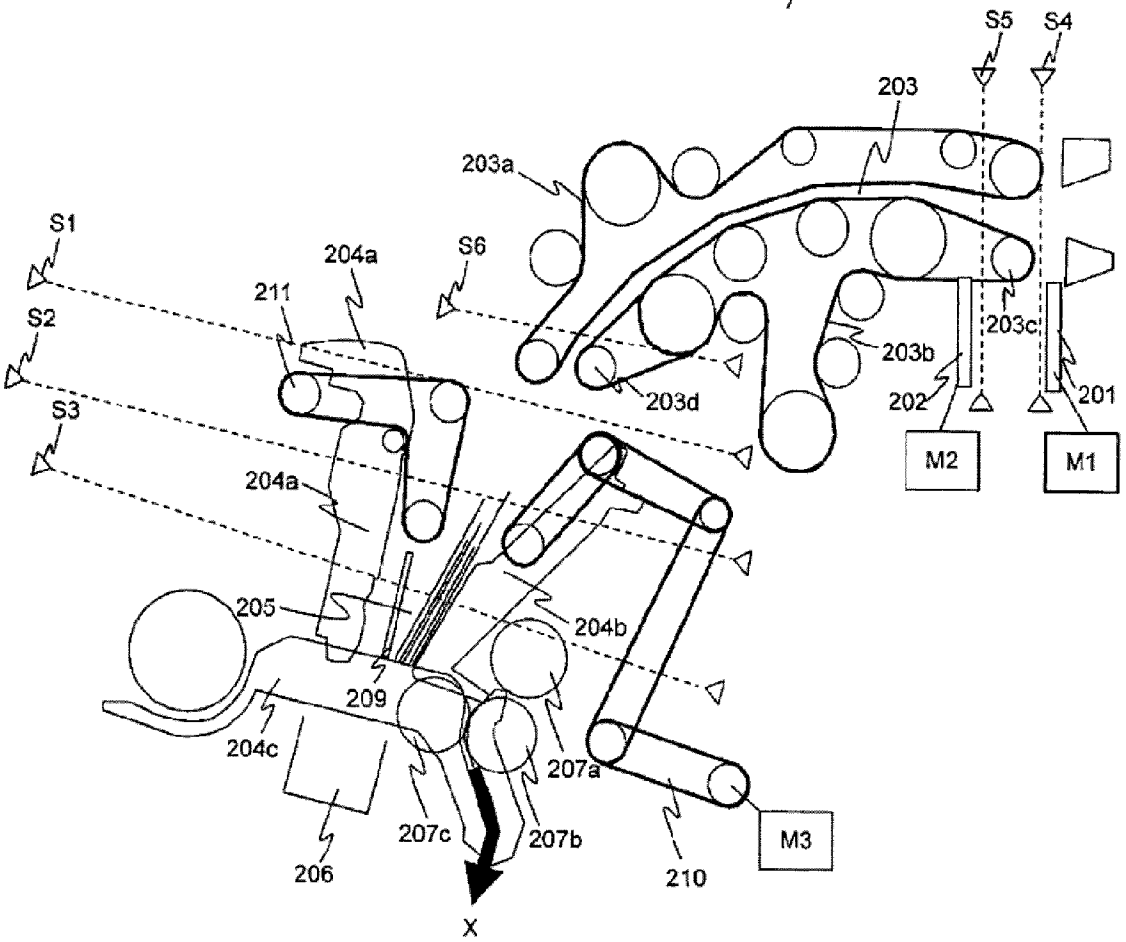
FIG. 7 is an inside configuration drawing of the deposit/withdrawal opening mechanism in the deposit counting motion.
Figure 8:
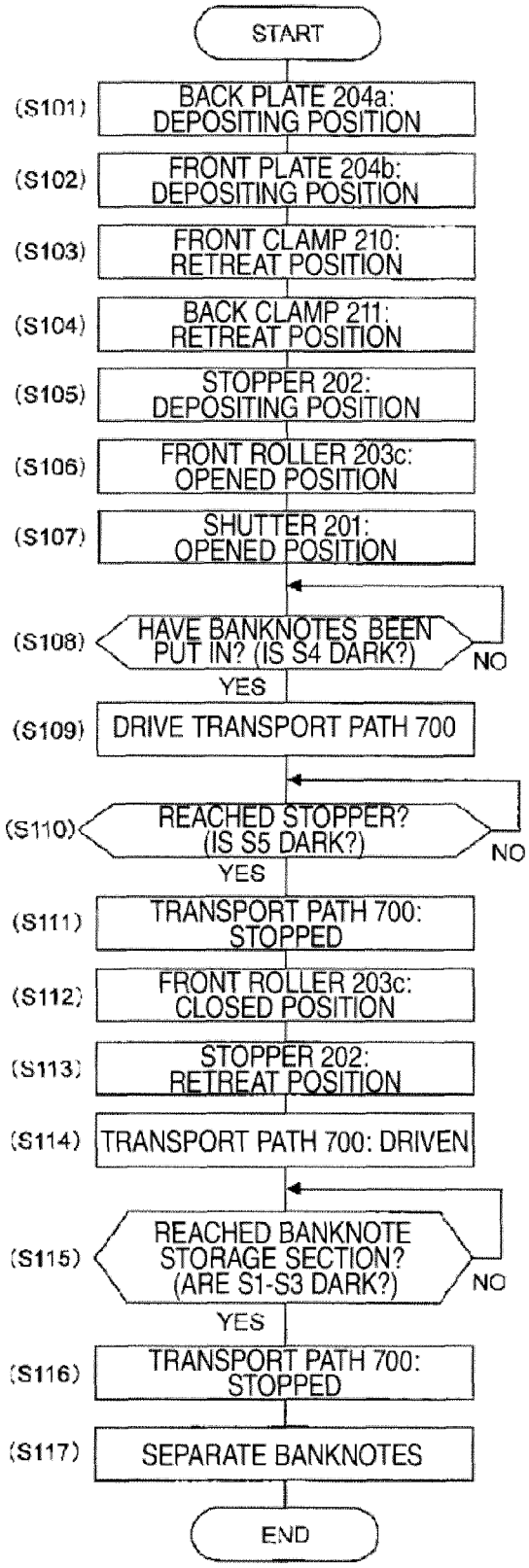
FIG. 8 is a flowchart showing the process of the deposit/withdrawal opening mechanism in the deposit counting motion.

FIG. 6 and FIG. 7 are drawings showing a state of the deposit/withdrawal opening mechanism 20 in the deposit counting motion. Also, FIG. 8 is a flowchart of the deposit/withdrawal opening mechanism 20 in the deposit counting motion.

First, the control unit 35 makes the back plate 204*a* and the front plate 204*b* move to the depositing position (S101, S102). Also, the order of S101 and S102 may be reversed. Next, the control unit 35 makes the front clamp 210 and the back clamp 211 move to the retreat position (S103, S104). Also, the order of S103 and S104 may be reversed. Then, the control unit 35 makes the stopper 202 move to the depositing position (a higher part of the device) (S105), places the front roller 203*c* in an opened position (S106), and thereafter makes the shutter 201 move to a lower part of the device so as to be placed in an opened position (S107). FIG. 6 is a drawing showing a state the banknotes have been deposited by the user after the process has been completed to S107.

After the state shown in FIG. 6, the banknotes are detected by the sensor S4 (S108: YES), and the control unit 35 thereafter makes the banknote transport path 203 be driven to the arrow direction shown in FIG. 6 (S109). Then, after the transported banknotes are detected by the sensor S5 (S110: YES), the control unit 35 makes driving of the banknote transport path 203 stop once (S111). Also, the control unit 35 makes the front roller 203*c* move to a closed position (S112), and makes the stopper 202 move to the lower part of the device so as to be in the retreat position (S113). Thereafter, by making the banknote transport path 203 be driven again, the control end 35 makes the banknotes 218 be driven toward the storage section 205 (S114). Although the back roller 203*d* is in a state of being closed to the banknote transport path 203 side, the banknotes are transported as they are, and are put in to the storage section 205. Alter an event that the banknotes reached the storage section 205 has been detected by the sensors S1-S3 (S115: YES), the control unit 35 makes driving of the banknote transport path 203 stop (S116). FIG. 7 is a drawing showing a state the banknotes have been stored in the storage section 205 after the process has been completed to S116. Thereafter, the control unit 35 makes separation of the banknotes by the pick roller 207*a*, the separation roller 207*b* and the gate roller 207*c* start, and makes the banknotes be transported toward the arrow X direction shown in FIG. 2 (S117).

The attitude of the banknotes put in by the user is corrected by the stopper 202. Also, even if the banknotes may become a skewed state during transportation, because the banknotes are accumulated in an upright state in the storage section 205, when the banknotes bumps into the bottom plate 204*c* of the storage section 205, the skew is corrected. Further, even if a foreign material such as a coin may be mixed inside the banknotes, the foreign material is accumulated by the gravity into the foreign material receive box 206 disposed in the vertical direction.

Figure 11:
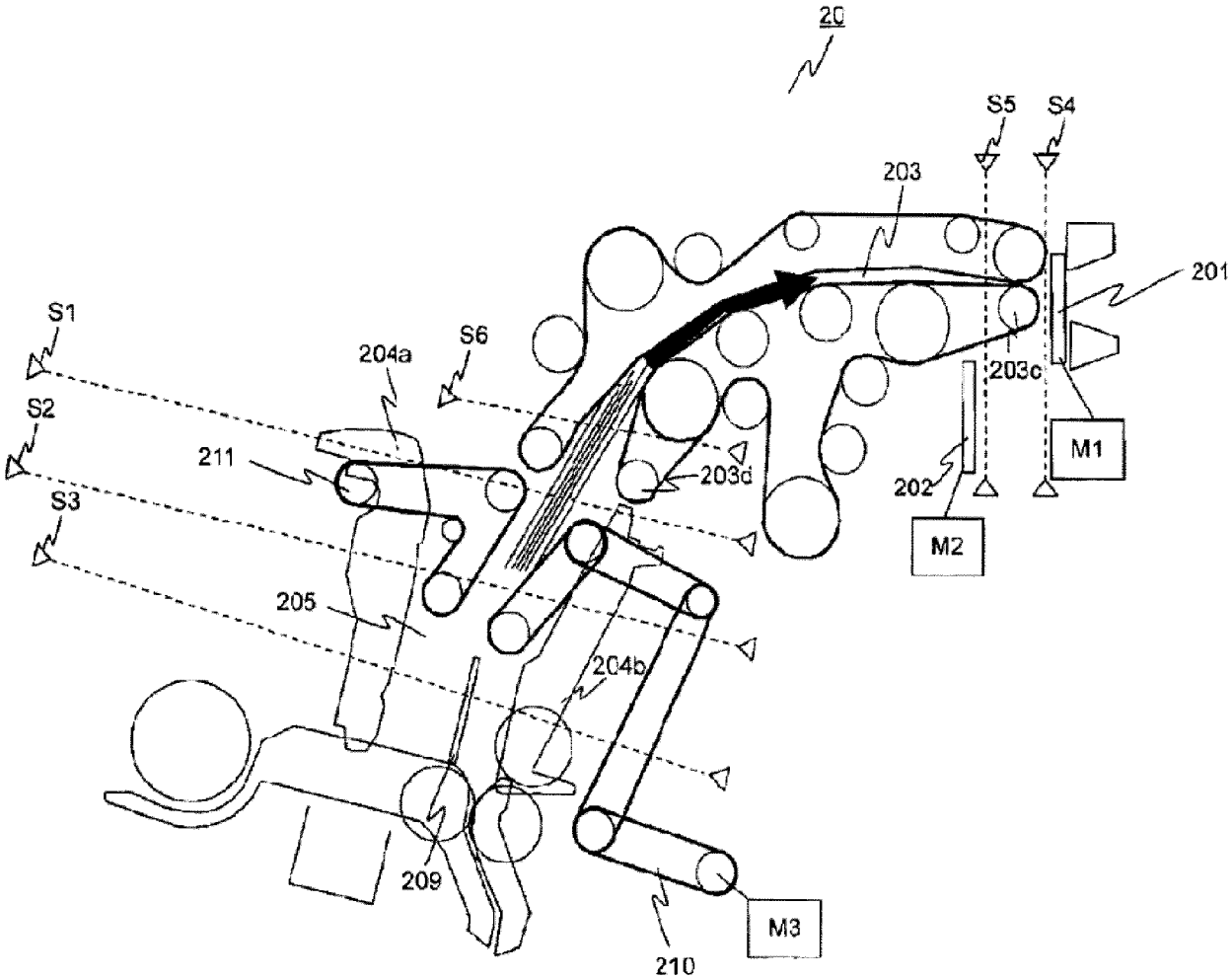
FIG. 11 is an inside configuration drawing of the deposit/withdrawal opening mechanism in the withdrawal motion.
Figure 12:
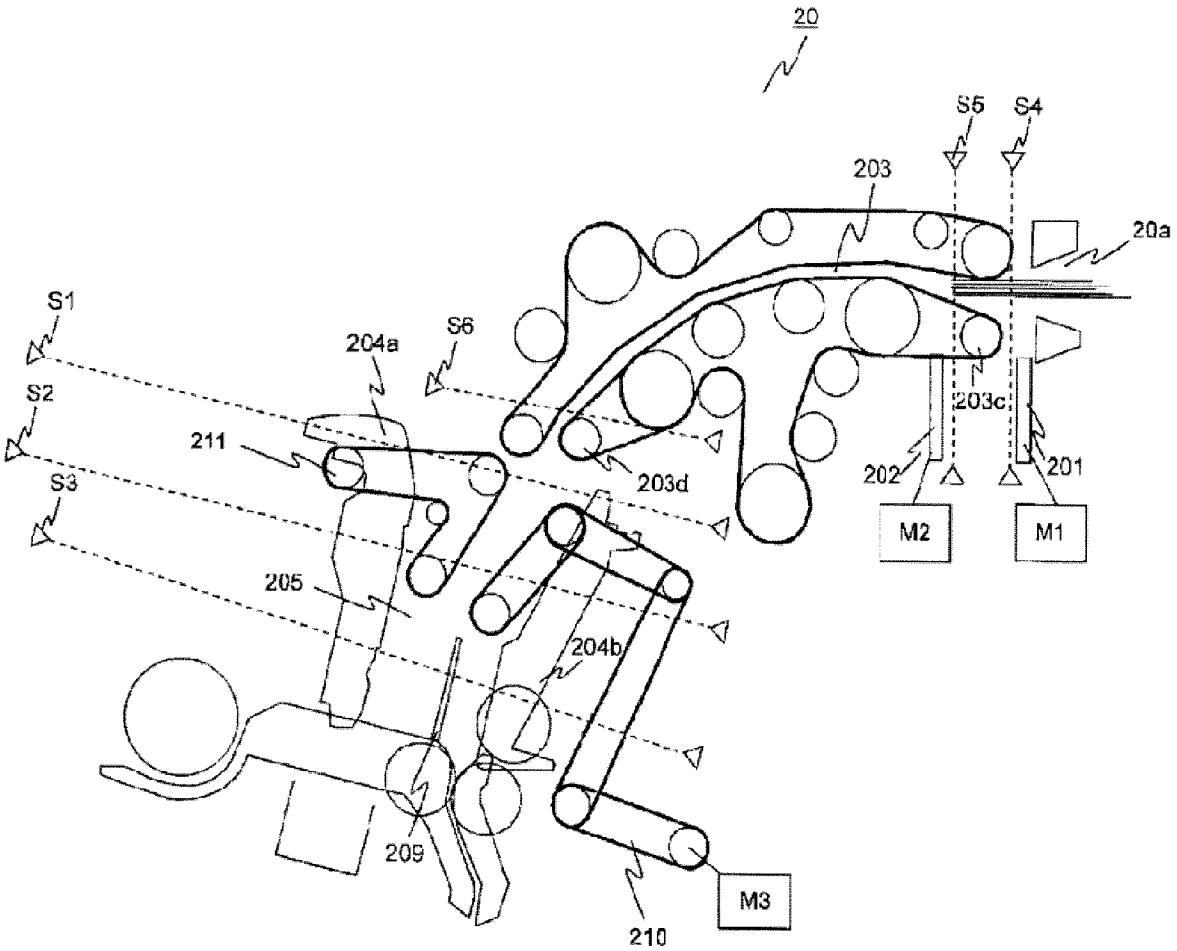
FIG. 12 is an inside configuration drawing of the deposit/withdrawal opening mechanism in the withdrawal motion.
Figure 13:
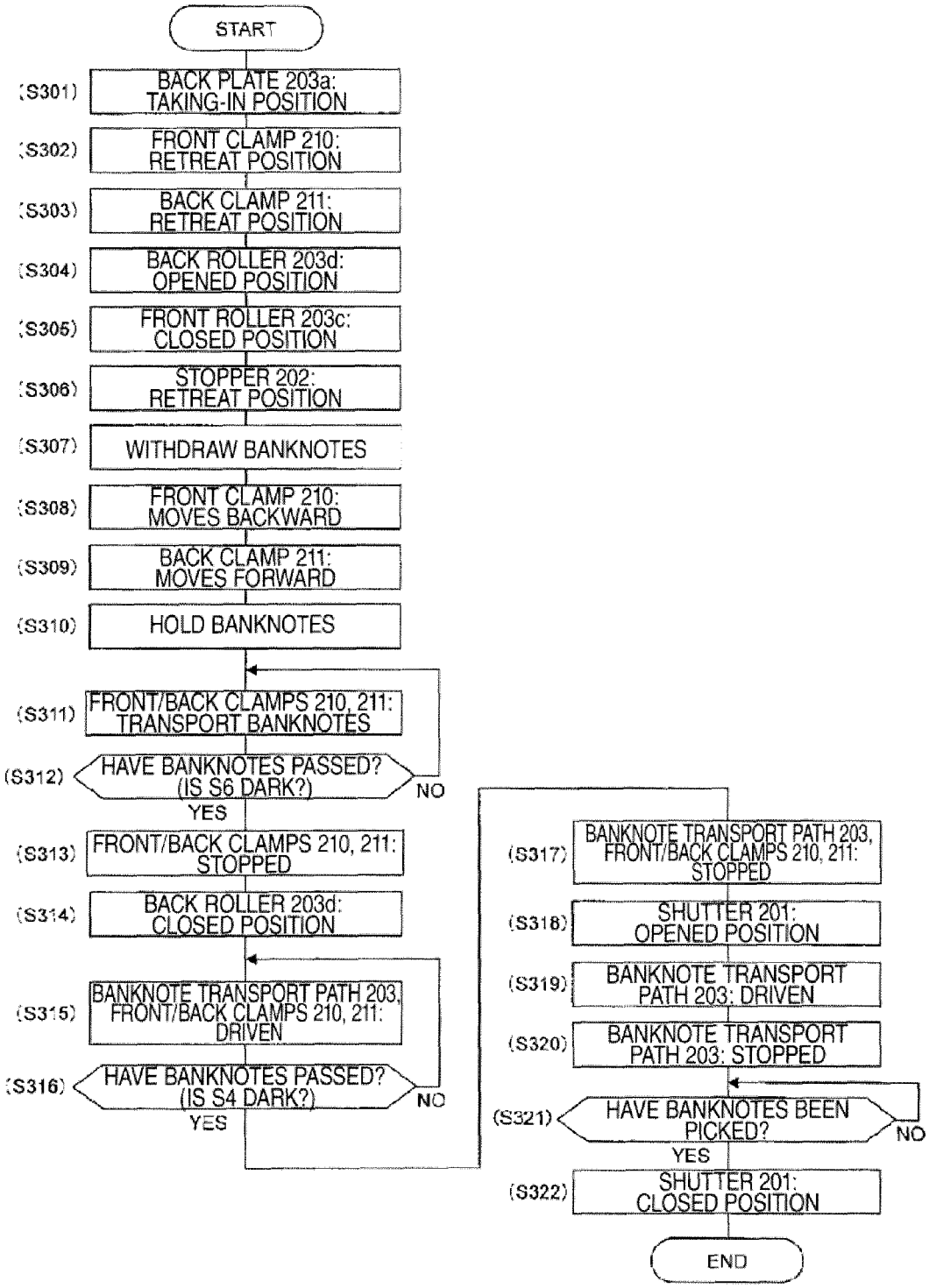
FIG. 13 is a flowchart showing the process of the deposit/withdrawal opening mechanism in the withdrawal motion.

FIG. 9-FIG. 12 are the drawings showing a state of the deposit/withdrawal opening mechanism 20 in the withdrawal motion. Also, FIG. 13 is a flowchart of the deposit/withdrawal opening mechanism 20 in the withdrawal motion.

First, the control unit 35 makes the back plate 204*a* move to the taking-in position (the front of the device) (S301), places the front clamp 210 and the back clamp 211 in a state retreating to the outside of the storage section 205, makes the back roller 203*d* move to an opened position (a side departing from the banknote transport path 203), makes the front roller 203*c* move to a closed position (the banknote transport path 203 side), and makes the stopper 202 move to a retreat position (the lower side of the device) respectively (S302, 303, 304, 305, 306), Also, the order of S301-306 is optional.

Figure 9:
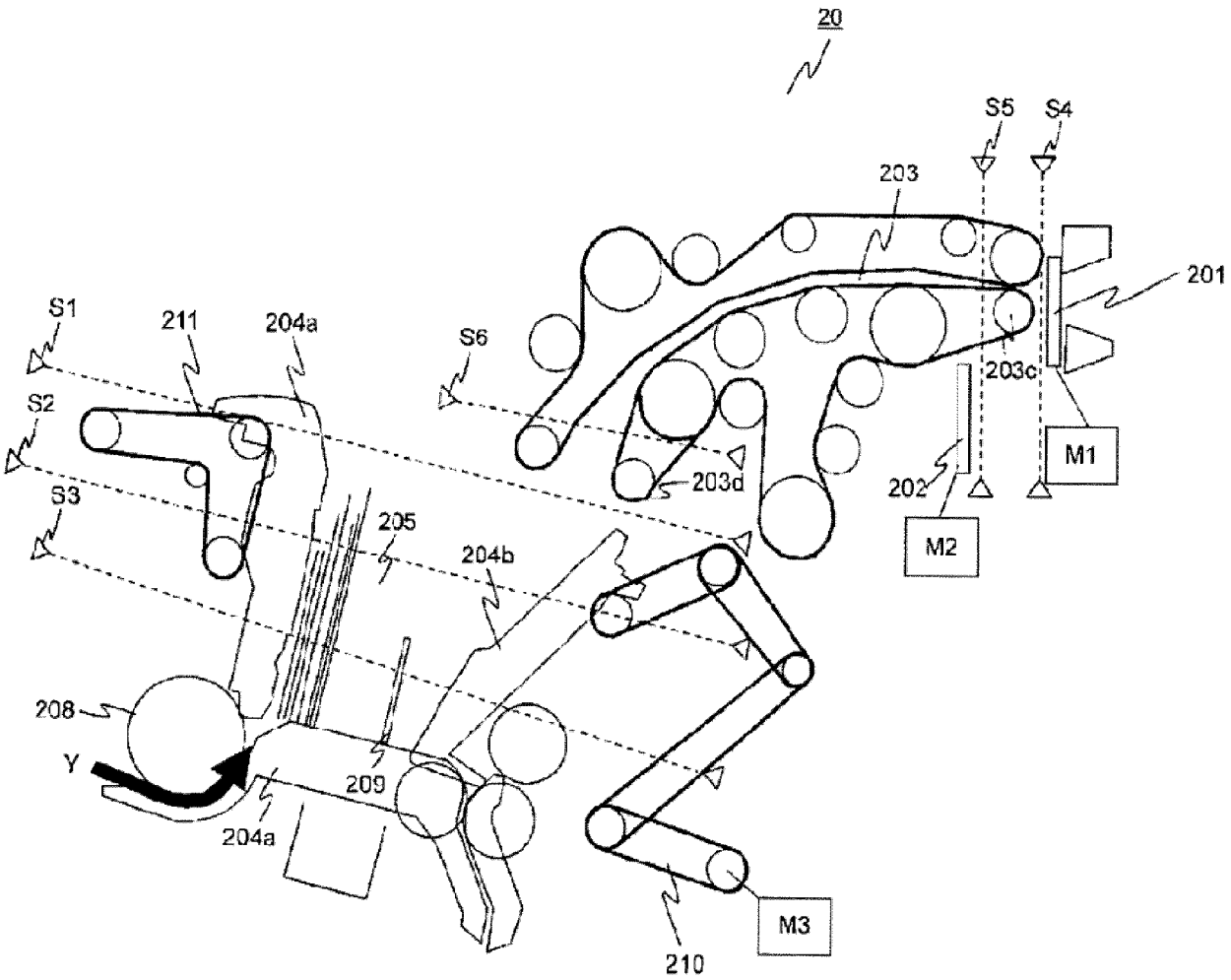
FIG. 9 is an inside configuration drawing of the deposit/withdrawal opening mechanism in the withdrawal motion.
Figure 10:
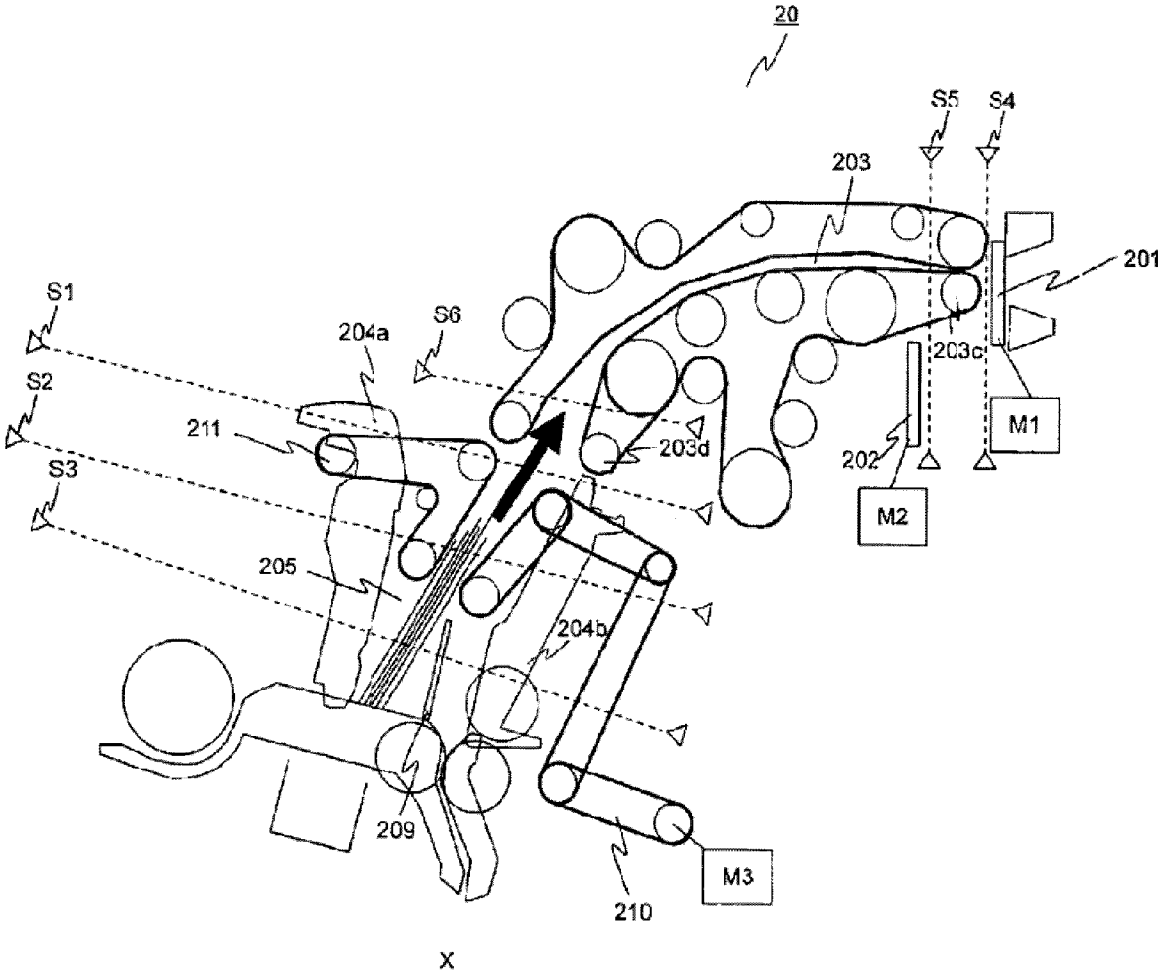
FIG. 10 is an inside configuration drawing of the deposit/withdrawal opening mechanism in the withdrawal motion.

Thereafter, as shown in FIG. 9, the control unit 35 accumulates the withdrawal banknotes transported from the arrow Y direction in the storage section 205 (S307). After accumulation of the withdrawal banknotes, the control unit 35 makes the front clamp 210, the back clamp 211 and the back plate 203*a* move (S308, S309), and holds the banknotes (S310). Also, the order of S308 and S309 may be reversed. FIG. 10 shows a state the banknotes are held after the process has been completed to S310.

The banknotes held by the front clamp 210 and the back clamp 211 axe projected from the storage section 205 by respective clamp belts of the front and back clamps, and are transported to the banknote transport path 203 (S311). FIG. 11 shows a state the banknotes have been transported to the banknote transport path 203 after the process has been completed to S311.

After an event the banknotes have reached the banknote transport path 203 has been detected by the sensor S6 (S312: YES), the control unit 35 makes driving of the front clamp 210 and the back clamp 211 stop (S313). Thereafter, the control unit 35 makes the back roller 203*d* move to a closed position (S314), makes the front clamp 210, the back clamp 211 and the banknote transport path 203 be driven, and makes the banknotes be transported toward the shutter 201 and the stopper 202 (S315). After the banknotes have been detected by the sensor S4 (S316: YES), the control unit 35 makes the front clamp 210, the back clamp 211 and the banknote transport path 203 stop (S317), and opens the shutter 201 (S318). Thereafter, the control unit 35 makes the banknote transport path 203 be driven again (S319), makes the banknotes project from the opening 20*a*, and makes the banknote transport path 203 stop (S320). FIG. 12 shows a state the banknotes have projected from the opening 20*a* after the process has been completed to S320. After an event the banknotes have been picked (an event the sensor becomes a lit state) has been detected by the sensor S4 (S321: YES), the control unit 35 closes the shutter 201 (S322).

Further, also in a case the depositing rejected banknote comes up, the process similar to that of the withdrawal motion is executed. When the depositing rejected banknote comes up and separation of the banknotes stops due to some reason, the depositing rejected banknote and the banknotes not yet separated come to be present in the front and the back of the partition plate 209. In this case, the banknotes held by the front clamp 210 and the back clamp 211 in a state straddling the partition plate 209 are delivered to the banknote transport path 203 in a state projected from the storage section 205, and are transported to the opening 20*a*.

As described above, by arranging the transport path for transporting the banknote bundles in a lump above the storage section that separates and accumulates the banknotes in an upright state and by projecting the transport path to the user operation surface horizontally, user-friendliness is improved, the banknotes bundle can be taken in with the edge face of the banknote bundle set with various sizes and attitudes being arrayed to prevent the skew, therefore jamming and rejection can be prevented in each motion such as separation, transportation, identification and accumulation thereafter, and a device with high reliability can be provided. Also, such device can be provided that has excellent removability of coins and the like mixed in the banknote bundles.

Also, because the banknote bundles can be arrayed by the stopper before the banknotes are put in, the skew can be prevented, and a device having excellent transportation performance can be provided.

Further, by employing the present device, the direction of receipt and delivery of the banknotes, cards, media such as receipts discharged from the cash dispenser and the direction of receipt and delivery of the deposit/withdrawal banknotes of the present device become same, and a device having excellent operability for a user can be provided.

Also, because the transport unit in the upper side of the storage section can be detached from the storage section, when it is not necessary to receive and deliver the banknotes horizontally, by detaching the transport unit, it becomes possible to receive and deliver the banknotes from/to a user in the clamp inside the storage section, and a device that is more compact and has higher reliability can be provided.

REFERENCE SIGNS LIST

20: deposit/withdrawal opening mechanism
101: banknote deposit/withdrawal machine
101*a:* banknote slot
101*b:* safe casing
101U: upper banknote mechanism
101L: lower banknote mechanism
201: shutter
202: stopper
203: banknote transport path
205: storage section
206: foreign material receive box
209: partition plate
210: front clamp
211: bank clamp

The invention claimed is:

1. A paper-slip handling device, comprising:
a deposit/withdrawal unit adapted for depositing and withdrawal of paper slips;
a paper-slip identification unit that identifies the paper slips;
a temporary holding compartment that temporarily stores the deposited paper slips;
a plurality of paper-slip storage compartments; and
a first paper-slip transport path via which the paper slips are transported to respective units, wherein
the deposit/withdrawal unit includes an opening via which the paper slips are transferred in a substantially horizontal state, a storage section that stores the paper slips in a substantially upright state, and a second paper-slip transport path that connects the opening and the storage section, with the paper slips being transported via the second paper-slip transport path while being changed between a substantially upright state and a substantially horizontal state. the second paper-slip transport path having a bending configuration formed of a plurality of belts.

2. The paper-slip handling device according to claim 1 wherein
the second paper-slip transport path is arranged in the upper part of the storage section.

3. The paper-slip handling device according to claim 1 wherein
the second paper-slip transport path is detachable with respect to the storage section.

4. The paper-slip handling device according to claim 1 wherein
the deposit/withdrawal unit includes a holding means that switches between holding and non-holding of banknotes stored in the storage section.

5. The paper-slip handling device according to claim 4 further comprising:

a control unit that controls the respective units, wherein the control unit makes banknotes held by the holding means be transported to the second paper-slip transport path in a withdrawal transaction.

6. An automated transaction device comprising the paper-slip handling device according to claim 1.

7. The paper-slip handling device according to claim 1, further comprising an openable and closable roller configured to impart a transporting force to the paper slips in a closed state, and receive the banknotes in an opened state, on a device front side or a device back side of the second paper-slip transport path.

8. A paper-slip handling device, comprising;

a deposit/withdrawal unit adapted for depositing and withdrawal of paper slips;

a paper-slip identification unit that identifies the paper slips;

a temporary holding compartment that temporarily stores the deposited paper slips;

a plurality of paper-slip storage compartments;

a first paper-slip transport path via which the paper slips are transported to respective units, wherein the deposit/withdrawal unit includes an opening via which the paper slips are transferred in a substantially horizontal state, a storage section that stores the paper slips in a substantially upright state, and a second paper-slip transport path that connects the opening and the storage section, with the paper slips being transported via the second paper-slip transport path while being changed between a substantially upright state and a substantially horizontal state;

a control unit that controls the respective units, wherein the deposit/withdrawal unit further includes a delivering mechanism that delivers the paper slips to the first paper-slip transport path, an accumulation mechanism that accumulates the banknotes transported from the first paper-slip transport path, and a partition plate that partitions the storage section, and the control unit makes the partition plate move so as to separate banknotes delivered by the delivering mechanism and banknotes accumulated by the accumulation mechanism from each other.

* * * * *